US005088740A

United States Patent [19]

Peterson

[11] Patent Number: 5,088,740

[45] Date of Patent: Feb. 18, 1992

[54] PRACTICE BACKSTOP FOR BALL PLAYING SPORTS

[75] Inventor: Leroy L. Peterson, Omaha, Nebr.

[73] Assignee: Sportsstuff, Inc., Omaha, Nebr.

[21] Appl. No.: 527,817

[22] Filed: May 24, 1990

[51] Int. Cl.[5] ..... A63B 63/00

[52] U.S. Cl. ..... 273/410; 135/104; 273/26 A; 273/29 A; 273/181 F; 273/407

[58] Field of Search ..... 273/410, 407, 26 A, 273/29 A, 181 R, 181 A, 181 F, 4111; 135/104

[56] References Cited

U.S. PATENT DOCUMENTS

| | | | |
|---|---|---|---|
| 1,540,670 | 6/1925 | Vidmer | 273/410 X |
| 2,922,653 | 1/1960 | O'Brien | 273/410 X |
| 4,045,032 | 8/1977 | Cox | 273/181 F |
| 4,491,141 | 1/1985 | Eppenbach | 135/104 |
| 4,590,956 | 5/1986 | Griesenbeck | 135/104 X |

*Primary Examiner*—William H. Grieb
*Attorney, Agent, or Firm*—John A. Beehner

[57] ABSTRACT

A practice backstop for ball playing sports has a support frame including a pair of crossed arcuate poles covered by a three sided enclosure, open at the front. A flexible target sheet is supported within the enclosure so as to be struck by and absorb the impact of balls directed at the backstop 10. The enclosure may additionally include a floor surface and a series of fasteners may be provided for supporting the target sheet at various front to back spaced apart positions within the enclosure.

9 Claims, 3 Drawing Sheets

PRACTICE BACKSTOP FOR BALL PLAYING SPORTS

BACKGROUND OF THE INVENTION

The present invention is directed generally to a practice backstop for ball playing sports and more particularly to a large yet lightweight and readily collapsible backstop which is most useful as a practice backstop for golf, soccer, baseball, football, tennis or any other sports involving the use of a ball.

The large permanent backstops commonly installed on baseball and softball diamonds are ill-suited for use in residential yards because of the size, cost and permanence. Furthermore, most such backstops are constructed with a fence fabric which is not adapted to stop balls as small as a golf ball.

Lightweight practice nets are available but these are supported by large cumbersome steel frames having a netting suspended therefrom and a plurality of tie-down cords that require ground penetrating stakes for securing the frame. Whereas such nets may be operative for golf, they typically are not designed to withstand the impact of larger heavier balls such as baseballs, softballs, footballs and the like. Furthermore, the frames, even when collapsed remain of substantial dimension thereby making storage and transport both difficult and inconvenient.

A primary object of the present invention, therefore, is to provide an improved practice backstop for ball playing sports.

Another object is to provide such a backstop which is self-supporting for ready placement on any support surface, indoors or out.

Another object is to provide such a backstop which is of large dimension, sturdy in construction and adapted for receiving and stopping balls as small as a golf ball and as large and heavy as softballs and footballs.

Another object is to provide such a backstop which has mesh walls and floor for placement on a lawn without blocking exposure of the covered grass to sun and water.

Another object is to provide such a backstop which includes a three-dimensional shock absorbing frame which co-acts with a separate target sheet suspended in spaced relation therefrom for absorbing the impact of balls directed into the backstop.

Another object is to provide such a backstop with a rear wall and forwardly extended sidewalls for containing balls directed against a separate target sheet suspended therein in spaced relation from the rear wall.

Another object is to provide such a backstop which may be easily collapsed into a lightweight compact package for convenient storage and transport.

Another object is to provide such a backstop which is simple and rugged in construction, economical to manufacture and efficient in operation.

SUMMARY OF THE INVENTION

The practice backstop of the present invention is adapted for use in connection with all ball playing sports ranging from golf and tennis to softball, baseball, soccer and football and even for such non-ball related sports as casting and other target sports and games. The backstop includes a support frame having a pair of crossed arcuate poles, each having opposite front and rear-ends adapted for support on a support surface. Segmented shock corded fiber glass poles afford substantial strength and flexibility without undue weight and size. A three-sided enclosure, open at the front, is supported on the frame and includes a rear wall and right and left sidewalls. These walls substantially fill the spaces between the poles on three sides of the frame. A flexible target sheet is supported in upright forwardly facing relation within the enclosure. The target sheet spans a substantial portion for the interior of the enclosure and is spaced from the rear wall so as to be struck by and absorb the impact of balls directed into the enclosure.

The flexible target sheet is preferably formed of a fabric material which may be imprinted with various target indicia such as a bull's eye, strike zone, tennis net line and the like. The target sheet is suspended within the enclosure by co-acting fasteners on the target sheet and enclosure. The enclosure may be provided with sets of fasteners spaced fore and aft apart for selective positioning of the target sheet at various depth within the enclosure.

The enclosure preferably includes a flexible floor of a mesh material so as not to block exposure of an underlying lawn surface to sun, air and water. The rear wall, sidewalls, and frame pole sleeves are likewise preferably formed of a mesh material to allow airflow therethrough. Whereas the bottom edges of the walls are preferably provided with spaced stake loops for use in windy conditions, the backstop is freestanding and operable without ground stakes.

BRIEF DESCRIPTION OF THE DRAWINGS

FIG. 3 is a front corner perspective view of the practice backstop including an auxiliary liner wall and the target sheet laid flat on the ground for golf pitching and the like;

DESCRIPTION OF THE PREFERRED EMBODIMENT

Figure 1:
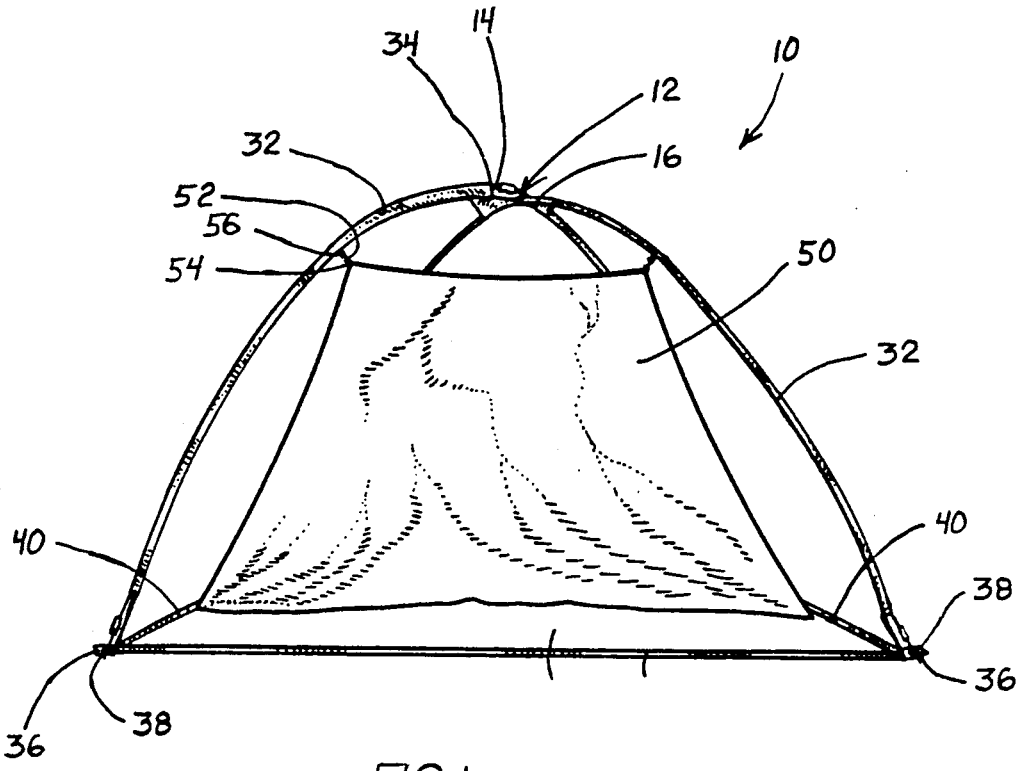
FIG. 1 is a front perspective view of the practice backstop of the invention.

The practice backstop 10 illustrated in the drawings is supported by a frame 12 including a pair of crossed arcuate poles 14 and 16. These are preferably segmented and shock corded fiberglass poles for effective strength in use and they are yet adapted for lightweight compact storage and transport when disassembled. Pole 14 has front and rear-ends 18 and 19 and pole 16 has front and rear-ends 20 and 21, each adapted for support on a support surface such as ground 22.

Frame 12 is covered by a three sided enclosure 24 which is open at the front and includes a rear wall 26 and right and left side walls 28 and 30. The side walls are preferably made of heavy duty nylon mesh with reinforced seams and stress points for a strong durable, yet lightweight, wall structure. The mesh allows wind to pass through the walls, thereby further reducing stress on the structure. The edges of each wall define mesh pole sleeves 32 which are sewn to the adjacent edge of an enclosure wall and which are adapted to receive one of the arcuate poles 14 or 16 therethrough. The sleeves 32 are likewise preferably made of a mesh material for decreased wind resistance. The sleeves 32 terminate at the upper end at 34 in spaced relation from the point of intersection of the poles to allow for passage of either pole above or below the other one. The bottom corner of each wall has a small strap 36 extended therefrom with a grommeted hole 38 for receiving an end of arcuate pole 14 or 16. A preferably nylon border 40 extends along the lower edge of each wall 26, 28, and 30 for strength and stretch resistance.

Figure 5:
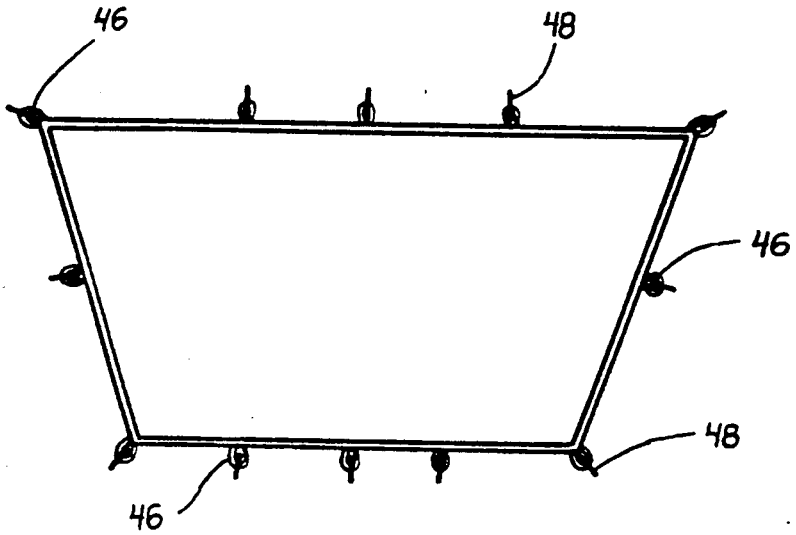
FIG. 5 is a top plan view of the floor of the practice backstop showing ground stake loops attached thereto.

In the preferred embodiment, backstop 10 additionally includes a flexible floor 42, preferably of a nylon mesh material, connected to and extended between the rear wall 26 and right and left side walls 28 and 30. The mesh floor may be connected to the border 40 and have a similar border 44 extending along the front edge thereof. The borders 40 and 44 are furthermore useful for securing a plurality of stake loops 46 thereto, as illustrated in FIG. 5. In windy weather, staking the backstop 10 to the ground is helpful for worry free placement. Ground stakes 48 inserted through loops 46 further stabilize the backstop for resisting the impact of larger heavier balls such as soccer balls and footballs.

In the alternative to ground stakes which cannot be used indoors, the backstop 10 is preferably provided with several nylon bags which may be filled with sand, rock or any other objects for placement on the floor surface 42 adjacent the walls for anchoring the backstop in a desired position.

Figure 4:
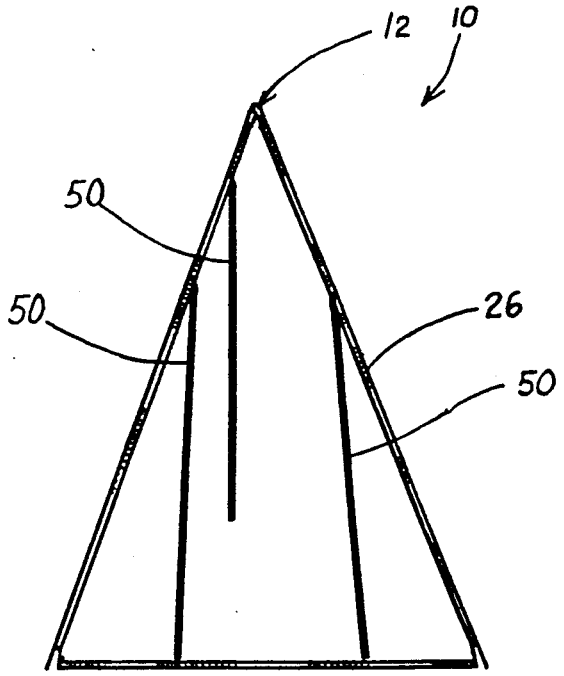
FIG. 4 is side elevational view of the practice backstop.
Figure 2:
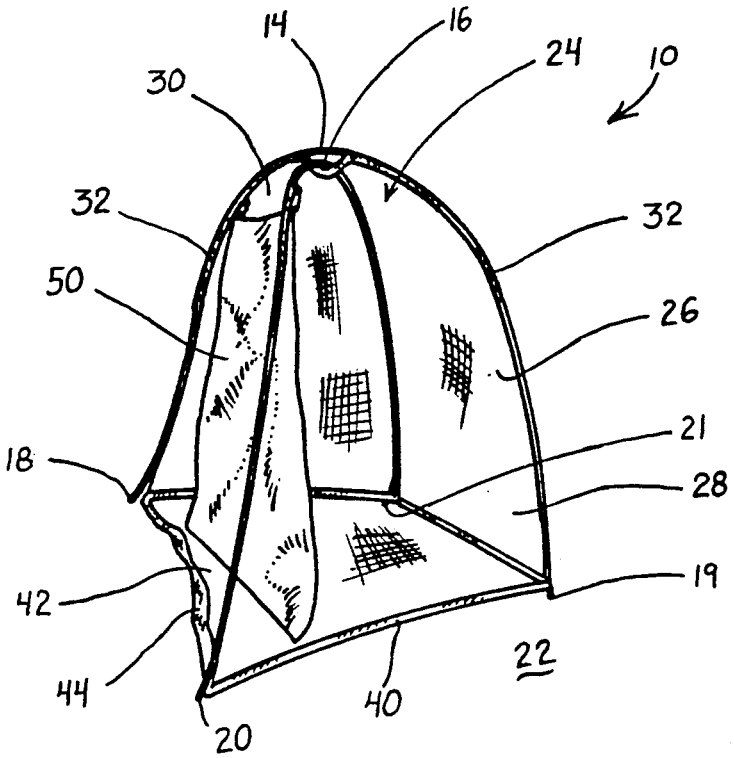
FIG. 2 is a side perspective view of the practice backstop.

A flexible target sheet 50 is adapted to be supported in upright forwardly facing relation within the enclosure 24. The target sheet is adapted to be struck by and initially absorb the impact of balls directed into the enclosure 24. Co-acting releasable fasteners are provided on at least the corners of the target sheet 50 and portions of the enclosure for supporting the target sheet. The co-acting fasteners preferably comprise small hooks 52 attached by elastic straps 54 to each corner of the generally trapezoid shaped target sheet 50. The elastic straps contribute to the shock absorbing function of the target sheet. The hooks 52 are engageable in loops or rings 56 connected by an appropriate strap to a seam along the pole sleeves 32 for maximum support. It is preferred that at least three pair of support loops 56 be provided at varying depths within the enclosure as illustrated in FIG. 4 so that the target sheet 50 may be supported at any selected one of a plurality of front to back spaced apart positions within the enclosure. Appropriately placed loops 56 may be provided along the floor border 44 for securement to hooks 52 on the bottom corners of the target sheet.

The flexibility of the arcuate poles 14 and 16 and fabric material of the walls and target sheet together with the elasticized hooks 52 all contribute to the shock absorbing capability of the backstop 10 of the invention. Whereas the entire backstop can be disassembled and stored in a relatively small nylon bag when not in use, it may be quickly and easily assembled within five minutes to provide a large freestanding backstop capable of receiving, stopping, and containing any type of ball that is thrown or hit into it, including golf balls, tennis balls, footballs, soccer balls, softballs and baseballs. The use of the backstop is not even limited to ball type sports since the large target would facilitate the practice of other sports, such as casting for fishing.

Figure 3:
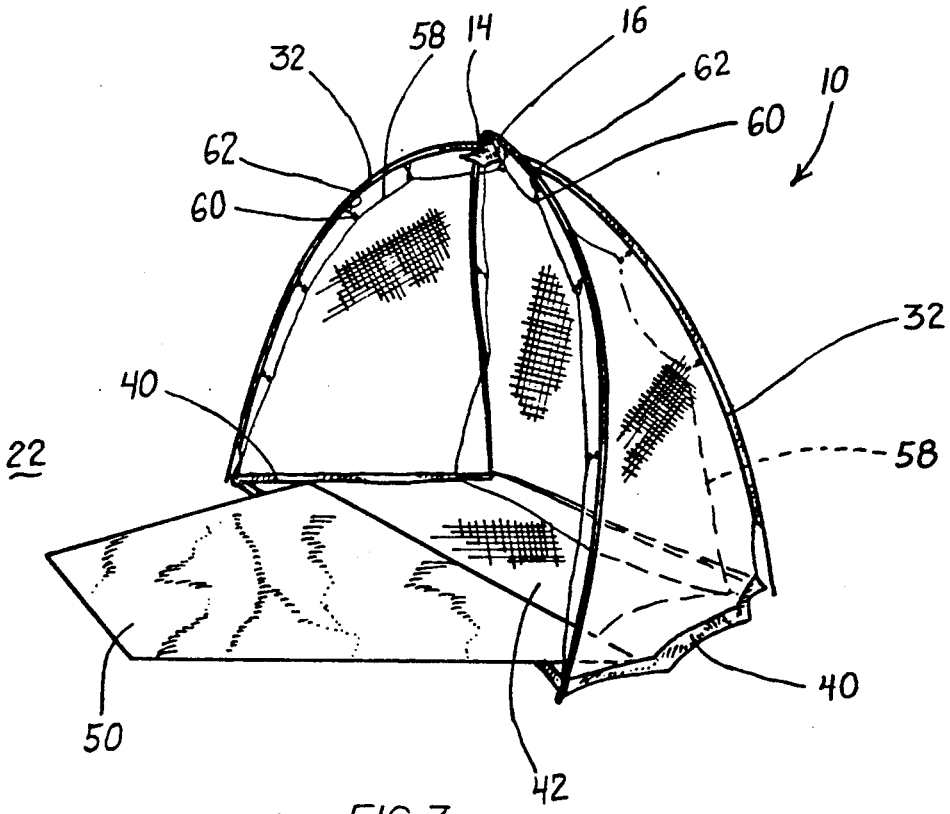

FIG. 3 illustrates an optional accessory for the backstop 10, namely an auxiliary mesh liner 58 which may be supported in spaced relation interiorly of walls 26, 28 and 30 for additional shock absorption. Liner 58 is provided with a plurality of fasteners 60, preferably hooks for securement to a plurality of loops or rings 62 ranged along the interior side of pole sleeves 32.

Whereas the size of the backstop 10 is not critical to the invention, a preferred embodiment is fourteen foot (14') wide at the bottom front, twelve foot (12') wide at the bottom back, eight feet (8') deep and ten feet (10') tall. Another preferable size includes a ten foot (10') front, eight foot (8') back, five foot (5') depth and eight foot (8') height. The larger backstop may preferably use eleven (11) millimeter fiberglass poles whereas the smaller backstop could use ten (10) millimeter poles.

The target sheet 50 is preferably a nylon sheet. Various graphics may be imprinted to provide a target, pitching zone, field goal zone, golf zone, soccer zone, pitching zone for golf and possibly even a golf flag imprint. The possibilities for visual effects are virtually unlimited.

With the practice backstop of the invention, an athlete can practice any shot any time, indoors or out, and never chase another ball again. The practice backstop affords the luxury of a personal golf range, which may be set-up right in one's backyard for practicing without leaving home. So many of the fundamentals of sports, such as accuracy, timing, technique, follow through, and eye, hand and foot coordination are improved by constant repetition and the immediate feedback of checking the results of each shot, throw, pitch, kick, toss, or whatever. The backstop 10 even enables the imaginative athlete to make up new family pastimes.

Whereas the invention has been shown in connection with a preferred embodiment thereof, it is understood that many modifications, additions or substitutions may be made which are within the intended broad scope of the appended claims.

Thus there has been shown and described a practice backstop which accomplishes at least all of the stated objects.

I claim:

1. A practice backstop for ball playing sports, comprising, a support frame including a pair of crossed arcuate poles, each pole having opposite front and rear ends adapted for support on a support surface, a three sided enclosure open at the front and including a rear wall and right and left side walls, said enclosure being supported on said frame and substantially filling the space between said poles on three sides of said frame, and a flexible target sheet, means for supporting said target sheet in upright forwardly facing relation within said enclosure, said target sheet spanning a substantial portion of the interior of said enclosure thereby to be struck by and absorb the impact of balls directed into said enclosure.

2. The practice backstop of claim 1 wherein the walls of said enclosure are formed substantially of a fabric mesh material.

3. The practice backstop of claim 2 wherein said flexible target sheet is formed substantially of a fabric material adapted to be imprinted with various target indicia thereon.

4. The practice backstop of claim 3 wherein said means for supporting said target sheet comprises a plurality co-acting releasable fastener means on said target sheet and enclosure.

5. The practice backstop of claim 1 wherein said means for supporting said target sheet includes means for selectively positioning said target sheet at any selected one of a plurality of front to back spaced apart positions within said enclosure.

6. The practice backstop of claim 1 wherein said enclosure further comprises a flexible floor connected to and extended between said rear wall and right and left sidewalls.

7. The practice backstop of claim 1 wherein the rear wall and right and left sidewalls of said enclosure have bottom edges adapted for ground engagement and further comprising securement means for stationarily securing said bottom edges in ground engagement.

8. The practice backstop of claim 7 wherein said securement means comprises a plurality of stake loops secured to each wall adjacent the bottom edge thereof in spaced apart relation there along.

9. The practice backstop of claim 7 wherein said securement means comprises a plurality of flexible bags adapted to be filled with any available material and for placement in operative relation to said bottom edges for anchoring said bottom edges relative to the ground.

* * * * *